US005730535A

United States Patent [19]

Keller et al.

[11] Patent Number: 5,730,535

[45] Date of Patent: Mar. 24, 1998

[54] SIMPLEX AND DUPLEX PRINTING SYSTEM USING A REVERSIBLE DUPLEX PATH

[75] Inventors: Paul D. Keller, Webster; Glenn M. Keenan, Rochester, both of N.Y.

[73] Assignee: Xerox Corporation, Stamford, Conn.

[21] Appl. No.: 786,953

[22] Filed: Jan. 23, 1997

Related U.S. Application Data

[62] Division of Ser. No. 537,055, Sep. 29, 1995, Pat. No. 5,598,257.

[51] Int. Cl.[6] ..... B41J 11/50

[52] U.S. Cl. ..... 400/605; 400/607; 400/607.2

[58] Field of Search ..... 400/188, 582, 400/584, 605, 607, 607.2

[56] References Cited

U.S. PATENT DOCUMENTS

| | | | |
|---|---|---|---|
| 4,623,900 | 11/1986 | Watanabe | 400/188 |
| 4,932,798 | 6/1990 | Kardinal et al. | 400/188 |
| 4,978,980 | 12/1990 | Noguchi et al. | 400/188 |
| 5,101,222 | 3/1992 | Hakkaku | 400/188 |
| 5,568,246 | 10/1996 | Keller et al. | 355/309 |

FOREIGN PATENT DOCUMENTS

| | | | |
|---|---|---|---|
| 40-5131696 | 5/1993 | Japan | 400/188 |

OTHER PUBLICATIONS

The Hardcopy Observer: Nov. 1993, p. 30, "Siemens Launches PCL–Compatible High Speed Page Printers".

*Primary Examiner*—John S. Hilten
*Attorney, Agent, or Firm*—Lloyd F. Beani

[57] ABSTRACT

A printing system for producing a print job, the printing system including a print engine for imaging regular substrates, fed to the print engine from a regular substrate feeding apparatus and delivering the imaged regular substrates to an output; and a duplexer operatively coupled to the print engine having a first path for feeding imaged regular substrates to the print engine for duplex printing, the duplexer having a second, sheet insertion, path for feeding special sheets to the output of imaged regular substrates.

9 Claims, 2 Drawing Sheets

SIMPLEX AND DUPLEX PRINTING SYSTEM USING A REVERSIBLE DUPLEX PATH

This application is a division of application Ser. No. 08/537,055, filed Sept. 29, 1995, now U.S. Pat. No. 5,598,257.

BACKGROUND OF THE INVENTION

This invention relates generally to a document handling system for transporting sheets to and from a fusing station and more particularly concerns a document handling system for sequentially transporting sheets to and from the fuser having a selectable shunt or buffer path permitting selected sheets to bypass the fuser station.

The primary output product of a typical printing machine is a printed substrate, such as a sheet of paper bearing printed information in a specified format. Quite often, customer requirements necessitate that this output product be configured in various specialized arrangements or print sets ranging from stacks of collated loose printed sheets to tabulated and bound booklets. Even when using state of the art document producing and finishing apparatus, it may be necessary to insert sheets into the document which are produced by means other than the document producing apparatus, or produced at a separate time from the majority of the sheets contained in the print set. For example, it is not uncommon to place specially colored sheets, chapter dividers, photographs or other special insert sheets into a print set to produce a final document. For example, it is common to use preprinted sheets which were produced by four-color offset press techniques as special insert sheets in a document containing mostly text printed on ordinary white paper. In another example, booklets produced from signatures, often use special cover sheets or center sheets containing, for example, coupons. It is generally not desirable to pass these sheets through the fuser station because the ink on the special insert sheets tends to be smudged or damage by heat of the fuser roll, etc. In addition, these special insert sheets may be of a particular weight stock or may include protruding tabs which may cause jams when transported through the fuser station.

Accordingly, these special insert sheets must be inserted into the stream of sheets subsequent to processing in the printer processor section of the document producing apparatus. It is desirable to insert these sheets without disrupting the flow of the continuous stream of processed sheets. It is also desirable to insert these sheets in a manner which is transparent to the print processor on the finishing apparatus so that the operation of these apparatus need not be modified. The following disclosures relate to the area of inserting one or more insert sheets among a plurality of previously marked sheets:

U.S. Pat. No. 5,272,511
Patentees: Conrad et al.
Issued: Dec. 21, 1993
U.S. Pat. No. 4,961,092
Patentee: Rabb et al.
Issued: Oct. 2, 1990
U.S. Pat. No. 4,602,776
Patentee: York et al.
Issued: Jul. 29, 1986
U.S. Pat. No. 4,561,772
Patentee: Smith
Issued: Dec. 31, 1985

U.S. Pat. No. 4,536,078
Patentee: Ziehm
Issued: Aug. 20, 1985
U.S. Pat. No. 4,248,525
Patentee: Sterret
Issued: Feb. 3, 1981
Xerox Disclosure Journal-Vol. 19, No.4, pp.333–336
Patentee: John R. Yonovich
Disclosed: July/August 1994

U.S. Pat. No. 5,272,511 discloses a sheet inserter for inserting one or more special insert sheets into a continuous stream of sheets by overlaying the insert sheets with a corresponding sheet in the continuous stream of sheets. The insert sheet overlaying the corresponding sheet in the continuous stream of sheets is then conveyed with the corresponding sheet to a final destination where the sheets can be compiled into a stack.

U.S. Pat. No. 4,961,092 discloses a preprogrammed post collation system for a copier which uses plural sorter bins and a recirculating document handier. Preprogrammable pause points in the copying operation allow for repeatedly inserting a variable number of job inserts or other special copy sheets into the bins being fried (by producing copies of these special documents or by manually inserting them into the bins), at any selected document copying point. The copying sequence must be manually restarted after the appropriate insertion operation is completed.

U.S. Pat. No. 4,602,776 discloses an insertion apparatus for use with a copier and/or a collator for providing on-line and off-line insertion of sheet material or collation, respectively. A supply tray is loaded with one or more types of insert material, each type being separated by a first type of coded sheet. A copying operation is interrupted when a second type of coded sheet, located in the stack to be copied and indicating a location where insert sheets are to be inserted, is detected. As the insert sheets are fed, a second sensor detects the first type of coded sheet (indicating the end of the group of insert sheets), which is then fed to an overflow tray. The normal copying operation is then resumed.

U.S. Pat. No. 4,536,078 discloses an automatic document handling system for recirculative document duplex copying to provide precollated simplex or duplex copies with proper image orientation on the output copy sheet for copies made on special orientation restricted copy sheets as well as non-orientation sensitive copy sheets. A switching system is provided for selecting between feeding of copy sheets from a main supply tray or a special copy sheet supply tray. A control system is provided for causing the document handling system to circulate the input copy sheets once before copying, to count the input copy sheets and to determine whether an odd or even number of input sheets are being provided to improve operating efficiency.

U.S. Pat. No. 4,561,772 to Smith discloses several approaches for inserting orientation sensitive paper into a copier with a paper path loop and two paper trays disposed adjacent the loop. With the Smith copier, orientation sensitive paper can be loaded into one of the trays for feeding into the loop in accordance with the marking requirements of a copy job. In one example, a system operator informs the controller of the copier of the presence of orientation sensitive paper by activating a switch or button. Accordingly, the copy job is processed, in part, on the basis of the switch being activated.

U.S. Pat. No. 4,248,525 discloses an apparatus for producing sets of collated copies wherein some of the sheets in a document (regular sheets) can be reproduced in a collating mode by means of a copier having a recirculating document handler (RDH), while other sheets in the document (insert sheets) cannot be produced in a collating mode by the RDH. Each sheet which cannot be imaged using the RDH is first individually copied multiple times and fed to a separate storage bin. These sheets later will be inserted into the stream of collated regular sheets as they are copied and output from the copier. A controller is preprogrammed with the page numbers of the sheets to be inserted. The regular sized sheets are then placed (in order) in the RDH, and multiple collated copies are made and fed toward a finisher (stapler). Copies of the regular sized sheets in the document are thus output from the copier in order (collated), with the insert sheets missing. Since the controller keeps track of the number of sheets being copied, the controller is able to temporarily stop the RDH at the appropriate time and cause the appropriate insert sheet to be fed from its corresponding storage bin into the stream of regular sheets output from the copier. Thus, collated complete print sets of a particular document are generated.

The Xerox Disclosure Journal article discloses a dual function sheet feeder including first and second sheet feeding paths which share common initial document path portion, diverting at a gate to provide separate functions. The first sheet feeding path allows input documents to be transported for document imaging and onward to a document restacking tray. The second sheet feeding path allows transport of input documents into a print engine input path to be merged into the regular sheet feeding path for delivery to the finisher.

In various known printing systems, marking software is employed, in conjunction with one or more controllers, to implement a sheet scheduling technique. More particularly, in one known system each page of a job is programmed for printing and the corresponding marking related information is communicated to a print manager node. In turn, the print manager node generates a schedule indicating the sequence in which the sides of the job pages are to be printed. This is a straightforward process, provided each page is to be printed in simplex. If, however, approach, then the schedule must reflect the order in which the various selected ones of the pages are to be printed in duplex with a multipass sides of the pages are to be imaged. Pursuant to generating a schedule, the print manager node passes the schedule along to various other nodes, such as a marking node and a paper handling node, to coordinate operation of the printing system during the imaging process. When an inserter is used in conjunction with a print engine, the schedule generated by the print manager will, by necessity, include information regarding the times at which insertion sheets are to be fed into a stream of imaged sheets exiting the print engine. The following patents relate to the area of sheet scheduling:

U.S. Pat. No. 5,095,342
Patentees: Farrell et al.
Issued: Mar. 10, 1992
U.S. Pat. No. 5,184,185
Patentees: Rasmussen et al.
Issued: Feb. 2, 1993
U.S. Pat. No. 5,337,135
Patentees: Malachowski et al.
Issued: Aug. 9, 1994

U.S. Pat. No. 5,095,342 discloses a printing system with an endless duplex loop in which copy sheets to be imaged are inserted consecutively into the duplex loop without placing any skipped pitches therebetween regardless of set or job boundaries. Duplex side ones from subsequent sets or jobs are used to fill any gaps which exist in the duplex side one sheet stream of earlier sets or jobs.

U.S. Pat. No. 5,184,185 discloses a printing system wherein gaps, which naturally exist in the output of printed copy sheets from a duplex paper path due to duplex printing, are selectively combined with interset interval skipped pitches so as to provide an appropriate interset interval between each set of printed copy sheets output from a printer, while minimizing the number of skipped pitches which actually need to be scheduled.

U.S. Pat. No. 5,337,135 discloses a trayless duplex printer with a variable path velocity. The printer includes a paper path loop with plural drives driven by a variable speed drive. Through use of the variable speed drive, interleaving spaces can be generated between duplexing path sheets. Conversely, the variable speed drive can be operated so as to close up interleaving spaces.

All references cited in the present specification and their references are incorporated herein by reference where appropriate for appropriate teachings of additional or alternative details, features and/or technical background.

SUMMARY OF THE INVENTION

Accordingly, the present invention provides a printing system for producing a print job, the printing system including a print engine for imaging regular substrates, fed to the print engine from a regular substrate feeding apparatus and delivering the imaged regular substrates to an output; and a duplexer operatively coupled to the print engine having a first path for feeding imaged regular substrates to the print engine for duplex printing, the duplexer having a second, sheet insertion, path for feeding special sheets to the output of imaged regular substrates.

In a tandem printing system for producing a print job, the printing system includes a first print engine for imaging a regular substrate, fed to the print engine from a regular substrate feeding apparatus and delivering the imaged regular substrates to a common path; a second print engine for imaging said regular substrate fed to the second print engine from said common path and delivering the imaged regular substrates to an output; and a duplexer, operatively coupled to said second print engine, having a fast path for feeding imaged regular substrates to the second print engine for duplex printing, said duplexer having a second, bypass, path for feeding selected substrates to said output of imaged regular substrates.

In a tandem engine printing system having a dual mode for producing a print job, the printing system includes a first print engine for imaging first side of a regular substrate, fed to the first print engine from a regular substrate feeding apparatus and delivering the imaged regular substrates to a common path during a first mode; a second print engine, operatively coupled to said first print engine, for imaging an opposing side of said regular substrate fed to the second print engine from said common path and delivering the imaged regular substrates to an output during said first mode; and a duplexer, operatively coupled to said second print engine, having a first path for feeding imaged regular substrates to the second print engine for duplex printing, said duplexer having a second, bypass, path for feeding selected substrates to said output of imaged regular substrates, during said first mode.

BRIEF DESCRIPTION OF THE DRAWINGS

The foregoing and other features of the instant invention will be apparent from a further reading of the specification, claims and from the drawings in which:

All references cited in this specification, and their references, are incorporated by reference herein where appropriate for teachings of additional or alternative details, features, and/or technical background.

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
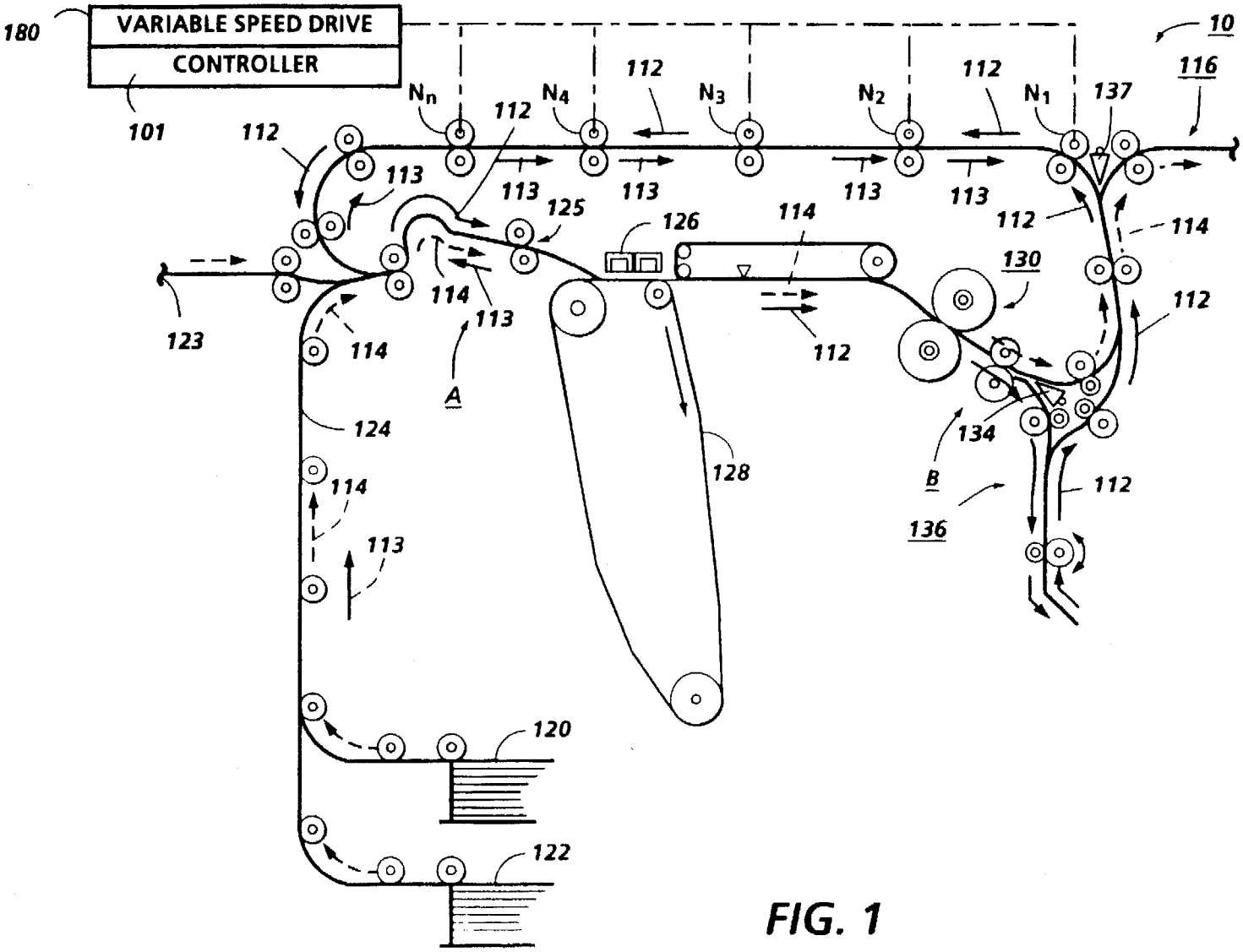
FIGS. 1 and 2 are an elevational view illustrating schematically an endless loop duplex path in which the present invention finds use.

For a general understanding of the features of the present invention, reference is made to the drawings. In the drawings like reference numerals have been used throughout to designate identical elements. FIG. 1 schematically depicts the various components of an illustrative electrophotographic printing machine incorporating the present invention therein. It will become evident from the following discussion that the present invention is equally well suited for use in a wide variety of printing machines and is not necessarily limited in its application to the particular embodiment shown herein.

Describing first in further detail the exemplary printer embodiment with reference to FIG. 1, there is shown a duplex laser printer 10 by way of example of automatic electrostatographic reproducing machines of a type like that of the existing commercial Xerox Corporation "DocuTech" printer shown and described in U.S. Pat. No. 5,095,342 suitable to utilize the decurling system of the present invention. Although the disclosed method and apparatus is particularly well adapted for use in such digital printers, it will be evident from the following description that it is not limited in application to any particular printer embodiment. While the machine 10 exemplified here is a xerographic laser printer, a wide variety of other printing systems with other types of reproducing machines may utilize the disclosed system.

Turning now more specifically to this FIG. 1 system 10, the photoreceptor is 128, the clean sheets 110 are in paper trays 120 and 122 (with an optional high capacity input path 123), the vertical sheet input transport is 124, transfer is at 126, fusing at 130, inverting at 136 selected by gate 134. There is an overhead duplex loop path 112 with plural variable speed feeders $N_1$–$N_n$ providing the majority of the duplex path 112 length and providing the duplex path sheet feeding nips; all driven by a variable speed drive 180 controlled by the controller 101. This is a top transfer (face down) system. An additional gate 137 selects between output 116 and dedicated duplex return loop 112 here.

In this FIG. 1 embodiment, the endless loop duplex (second side) paper path 112 through which a sheet travels during duplex imaging is illustrated by the arrowed solid lines, whereas the simplex path 114 through which a sheet to be simplexed is imaged is illustrated by the arrowed broken lines. Note, however, that the output path 116 and certain other parts of the duplex path 112 are shared by both duplex sheets and simplex sheets, as will be described. These paths are also shown with dashed-line arrows, as are the common input or "clean" sheet paths from the paper trays 120 or 122.

After a "clean" sheet is supplied from one of the regular paper feed trays 120 or 122 in FIG. 1, the sheet is conveyed by vertical transport 124 and registration transport 125 past image transfer station 126 to receive an image from photoreceptor 128. The sheet then passes through fuser 130 where the image is permanently fixed or fused to the sheet. After passing through the fuser, a gate 134 either allows the sheet to move directly via output 116 to a finisher or stacker, or deflects the sheet into the duplex path 112, specifically, first into single sheet inverter 136 here. That is, if the sheet is either a simplex sheet, or a completed duplex sheet having both side one and side two images formed thereon, the sheet will be conveyed via gate 134 directly to output 116. However, if the sheet is being duplexed and is then only printed with a side one image, the gate 134 will be positioned by sensor 132 (led emitter and receiver) and controller 101 to deflect that sheet into the inverter 136 of the duplex loop path 112, where that sheet will be inverted and then fed to sheet transports 124 and 125 for recirculation back through transfer station 126 and fuser 130 for receiving and permanently fixing the side two image to the backside of that duplex sheet, before it exits via exit path 116.

In the inserter mode, a insert sheet is supplied from one of the regular paper feed trays 120 or 122, the sheet is conveyed by vertical transport 124 to position A. When the insert reaches position A the feeder units reverse in direction and the insert sheet travels path 113 to gate 134 at position B. At position B, the feeder units are reverse so that at gate 134 the insert move directly via output 116 to a finisher or stacker.

Figure 2:
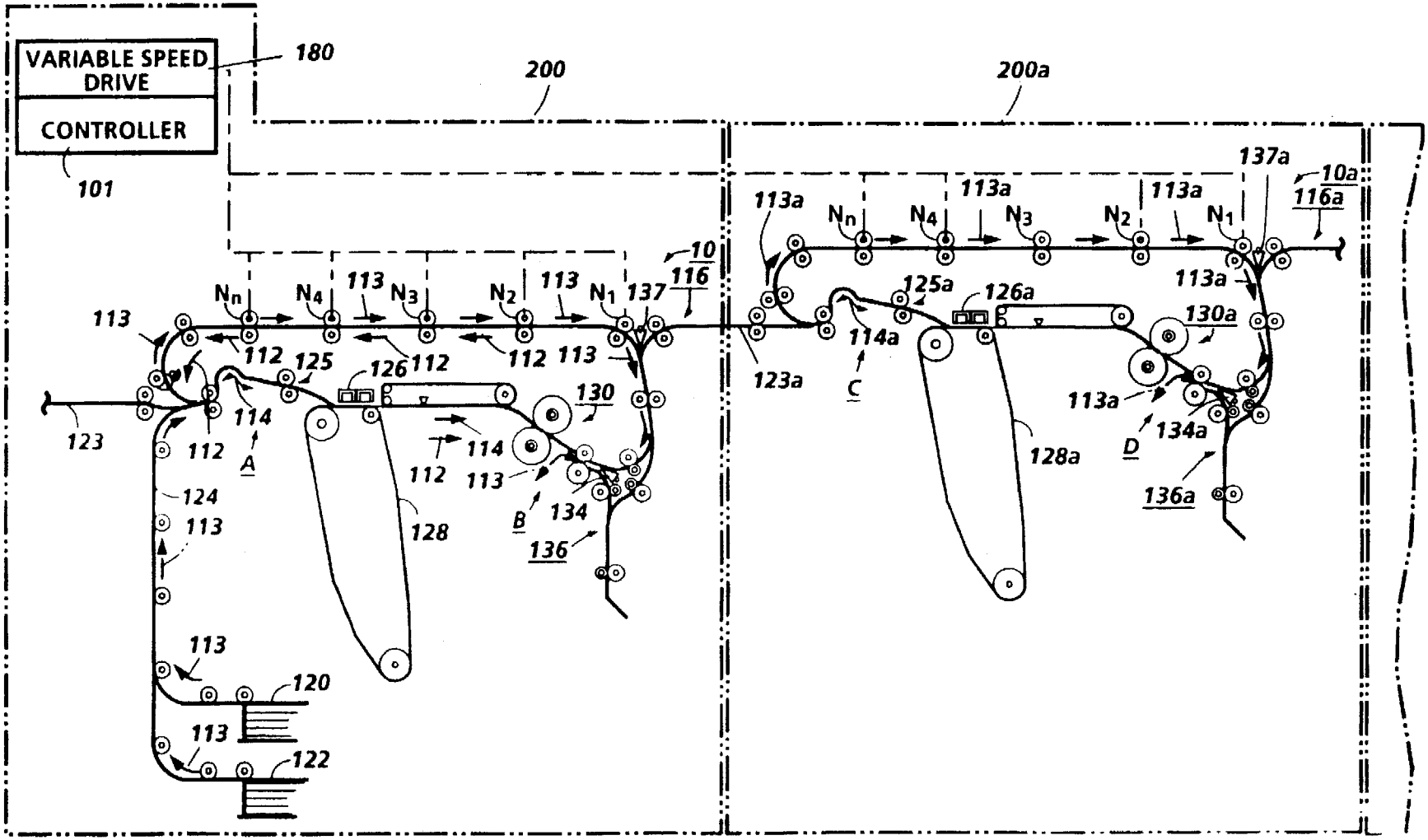

The present invention can be employed in a tandem print engines configuration as shown in FIG. 2. An advantageous feature of this configurations is that if one engine fails the other engine can be utilized by using the bypass path.

Referring to FIG. 2, in normal operation of the tandem print engines configuration a "clean" sheet is supplied from one of the regular paper feed trays 120 or 122 in FIG. 3, the sheet is conveyed by vertical transport 124 and registration transport 125 past image transfer station 126 to receive an image from photoreceptor 128. The sheet then passes through fuser 130 where the image is permanently fixed or fused to the sheet. After passing through the fuser, a gate 134 either allows the sheet to move directly via output 116 to module **200*a* to be a simplex sheet, or deflects the sheet into the duplex path 112, specifically, first into single sheet inverter 136 here. That is, if the sheet is to completed duplex sheet by module 200 having both side one and side two images formed thereon. The sheet is conveyed to registration transport 125*a* past image transfer station 126*a* to receive an image from photoreceptor 128*a*. The sheet then passes through fuser 130*a* where the image is permanently fixed or fused to the sheet. After passing through the fuser, a gate 134*a* either allows the sheet to move directly via output 116 to a finisher or stacker. If the sheet is to be simplex it is imaged by photoreceptor 128. After passing through the fuser, a gate 134 allows the sheet to move directly via output 116 to module 200*a*. The sheet is conveyed through via the by pass path 113*a* of module 200*a* to gate 134*a* where upon the sheet will be positioned by sensor 132 (led emitter and receiver) and controller 101 to deflect that sheet into the inverter 136 where that sheet will be inverted and then fed to the output 116*a*** to a finisher or stacker.

If the print engine in module 200 fails, a sheet is supplied from one of the regular paper feed trays 120 or 122, the sheet is conveyed by vertical transport 124 to position A. When the sheet reaches position A the feeder units reverse in direction and the sheet travels path 113 to gate 134 at position B. At position B, the feeder units are reverse so that at gate 134 the sheet move directly via output 116 to module 200*a*. The sheet is conveyed by transport 123*a* and registration transport 125*a* past image transfer station 126*a* to receive an image from photoreceptor 128*a*. The sheet then passes through fuser 130*a* where the image is permanently fixed or fused to the sheet. After passing through the fuser, a gate 134*a* either allows the sheet to move directly via output 116*a* to a finisher or stacker, or deflects the sheet into the duplex path 112*a*, specifically, first into single sheet inverter 136*a* here. That is, if the sheet is either a simplex sheet, or a completed duplex sheet having both side one and side two images formed thereon, the sheet will be conveyed via gate 134*a* directly to output 116*a*. However, if the sheet is being duplexed and is then only printed with a side one image, the gate 134*a* will be positioned by sensor 132*a* (led emitter and receiver) and controller 101 to deflect that sheet into the inverter 136*a* of the duplex loop path 112*a*, where that sheet will be inverted and then fed to sheet transport 125 for recirculation back through transfer station 126*a* and fuser 130*a* for receiving and permanently fining the side two image to the backside of that duplex sheet, before it exits via exit path 116*a*.

If the print engine in module 200*a* fails, a "clean" sheet is supplied from one of the regular paper feed trays 120 or 122 in, the sheet is conveyed by vertical transport 124 and registration transport 125 past image transfer station 126 to receive an image from photoreceptor 128. The sheet then passes through fuser 130 where the image is permanently fixed or fused to the sheet. After passing through the fuser, a gate 134 either allows the sheet to move directly via output 116 to a finisher or stacker, or deflects the sheet into the duplex path 112, specifically, first into single sheet inverter 136 here. That is, if the sheet is either a simplex sheet, or a completed duplex sheet having both side one and side two images formed thereon, the sheet will be conveyed via gate 134 directly to output 116. However, if the sheet is being duplexed and is then only printed with a side one image, the gate 134 will be positioned by sensor 132 (led emitter and receiver) and controller 101 to deflect that sheet into the inverter 136 of the duplex loop path 112, where that sheet will be inverted and then fed to sheet transports 124 and 125 for recirculation back through transfer station 126 and fuser 130 for receiving and permanently fixing the side two image to the backside of that duplex sheet, before it exits via exit path 116 to module 200*a*. The sheet is conveyed by transport 123*a* to position C. When the sheet reaches position C the feeder units reverse in direction and the sheet travels path 113*a* to gate 134 at position D. At position D, the feeder units are reverse so that at gate 134 the sheet move directly via output 116*a*.

The control of all machine functions, including all sheet feeding, is, conventionally, by a machine controller. The controller is preferably a known programmable microprocessor system, as exemplified by extensive prior art, e.g., U.S. Pat. No. 4,475,156 and its references. The controller conventionally controls all the machine steps and functions described herein, and others, including the operation of the document feeder, all the document and copy sheet deflectors or gates, the sheet feeder drives, the downstream finishing devices, etc. As further taught in the references, the controller also conventionally provides for storage and comparison of the counts of the copy sheets, the number of documents recirculated in a document set, the desired number of copy sets and other selections and controls by the operator through the console or other panel of switches connected to the controller, etc. The controller is also programmed for time delays, jam correction, etc. Conventional path sensors or switches may be utilized to help keep track of the position of the documents and the copy sheets and the moving components of the apparatus by connection to the controller. In addition, the controller variably regulates the various positions of the gates depending upon which mode of operation is selected.

While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A plural printing mode printing system for printing multisheet print jobs comprising dual printing engines with an operatively connected selectably variable sheet feeding paths system with variable sheet feeding paths, and a common sheet output;

wherein at least one of said selectably variable sheet feeding paths comprises at least one bypass sheet feeding path bypassing at least one of said dual printing engines, wherein in at least one said printing mode said selectably variable sheet paths are selected so that a first set of sheets is printed on one side by one of said dual printing engines while a second set of sheets is printed on one side by the other of said dual printing engines, with the sheets printed by one of said dual printing engines bypassing the other said print engine in said bypass sheet path, and with both said first and second sets of sheets from both of said dual printing engines being fed to and interleaved as a said multisheet print job in said common output to provide for increased simplex printing speed, and wherein in at least one said printing mode said selectably variable sheet paths include at least one duplex sheet inversion and insertion feeding path in which sheets printed on one side by at least one of said dual printing engines are re-inserted inverted into at least one of said dual printing engines to print said sheets on their opposite sides before said sheets are fed to said common output.

2. The plural mode printing system of claim 1 wherein in another said printing mode of said same plural mode printing system said selectably variable sheet paths are selected so that sheets printed on one side by at least one of said dual printing engines are printed by the other of said dual printing engines on their opposite sides before being outputted to said common output.

3. The plural mode printing system of claim 1 wherein said duplex sheet inversion and insertion path is at least partially bi-directional.

4. The plural mode printing system of claim 1 wherein said duplex sheet inversion and insertion feeding path is at least partially shared with said bypass sheet feeding path.

5. A plural printing mode printing method for printing multisheet print jobs with dual printing engines operatively connected by a selectably variable sheet feeding paths system with variable sheet feeding paths, which print job sheets are fed to a common sheet output;

wherein said selectably variable sheet feeding paths system is selectable to bypass at least one of said dual printing engines in at least one said printing mode, wherein in at least one said printing mode said selectably variable sheet paths are selected so that a first set of sheets is printed on one side by one of said dual printing engines while a second set of sheets is printed on one side by the other of said dual printing engines, with the sheets printed by one of said dual printing engines bypassing the other said print engine, and with both said first and second sets of sheets from both of said dual printing engines being fed to and interleaved as a said multisheet print job in said common output to provide for increased simplex printing speed, and wherein in at least one said printing mode said sheets are fed in said selectably variable sheet paths to provide at least one duplex sheet inversion and insertion in which sheets printed on one side by at least one of said dual printing engines are re-inserted inverted into at least one of said dual printing engines to print said sheets on their opposite sides before said sheets are fed to said common output.

6. The plural mode printing method of claim 5 wherein in another said printing mode of said same plural mode printing method said selectably variable sheet paths are selected so that sheets printed on one side by at least one of said dual printing engines are printed by the other of said dual printing engines on their opposite sides before being outputted to said common output.

7. The plural mode printing system of claim 5 wherein said duplex sheet inversion and insertion path is at least partially bi-directional so that in at least one said printing mode sheets are at least partially moved in one direction therein and in another said printing mode sheets are at least partially moved in another direction therein.

8. The plural mode printing system of claim 6 wherein said duplex sheet inversion and insertion feeding path is at least partially shared with said bypass sheet feeding path.

9. A method for printing multisheet print jobs in a printing machine having a plural printing mode printing system with dual printing engines with an operatively connected selectably variable paths sheet path system and a common output; comprising the steps of:

printing in at least one said printing mode, wherein said selectably variable sheet paths are selected so that a first set of sheets is printed on one side by one of said dual printing engines while a second set of sheets is printed on one side by the other of said dual printing engines, and with the sheets printed by one of said dual printing engines bypassing the other said print engine, and with both said first and second sets of sheets from both of said dual printing engines being interleaved as a said multisheet print job in said common output, said selectably variable sheet paths include at least one duplex sheet inversion and insertion path for returning sheets printed on one side by at least one of said dual printing engines to be re-inserted inverted into at least one of said dual printing engines to print said sheets on their opposite sides; and printing in another said printing mode, wherein said selectably variable sheet paths are selected so that sheets printed on one side by at least one of said dual printing engines are printed by at least one of said dual printing engines on their opposite sides.

* * * * *